US006481055B2

(12) United States Patent
Cheng

(10) Patent No.: US 6,481,055 B2
(45) Date of Patent: Nov. 19, 2002

(54) PIVOTAL DEVICE FOR A FRAMELESS GLASS DOOR

(76) Inventor: Ko Ming Cheng, Chang Chia Wei P.O. Box 25-7, Kaohsiung City 811 (TW)

( * ) Notice: Subject to any disclaimer, the term of this patent is extended or adjusted under 35 U.S.C. 154(b) by 18 days.

(21) Appl. No.: 09/835,786

(22) Filed: Apr. 10, 2001

(65) Prior Publication Data

US 2002/0144377 A1 Oct. 10, 2002

(51) Int. Cl.[7] ..... E05D 5/02; E05D 11/10

(52) U.S. Cl. ..... 16/252; 16/286; 16/250; 16/334; 16/382

(58) Field of Search ..... 16/252, 250, 251, 16/286, 284, 280, 382, 387, 334, 335; 49/397, 399, 381; 160/199, 206, 210, 213; 4/607, 557, 614

(56) References Cited

U.S. PATENT DOCUMENTS 5,297,313 A * 3/1994 Brin ..... 16/252
5,867,869 A * 2/1999 Garrett et al. ..... 16/252
5,867,871 A * 2/1999 Tasman ..... 16/335
6,070,294 A * 6/2000 Perkins et al. ..... 16/250
6,092,263 A * 7/2000 Boue et al. ..... 16/286
6,161,255 A * 12/2000 Garrett ..... 16/284

* cited by examiner

*Primary Examiner*—Anthony Knight
*Assistant Examiner*—Vishal Patel

(57) ABSTRACT

A pivotal device comprises a fixing plate fixed to a wall, a box securely attached to the fixing plate and including a horizontal space and a vertical space communicated with the horizontal space, and a follower slidably mounted in the horizontal space. Two stubs project from a side of the follower. A spring is mounted around each stub and has an end attached to the fixing plate. A first outer plate and a second outer plate are secured together, sandwich the box, and are pivotable relative to the box. A pivot pin is pivotally mounted in the vertical space of the box. A mediate portion of the pivot pin includes two opposite flat surfaces and two opposite arcuate surfaces. A gasket is securely sandwiched between the first outer plate and the second outer plate to move therewith. The gasket includes a portion for securely engage with an edge of a frameless glass door. The first side of the follower is pressed against by one of the flat surfaces and the arcuate surfaces of the mediate portion of the pivot pin during pivotal movement of the glass door relative to the box.

2 Claims, 6 Drawing Sheets

PIVOTAL DEVICE FOR A FRAMELESS GLASS DOOR

BACKGROUND OF THE INVENTION

1. Field of the Invention

The present invention relates to a pivotal device for a frameless glass door, and more particularly to a pivotal device assures stable, smooth pivotal movements for a frameless glass door.

2. Description of the Related Art

Decoration and arrangement of furniture means the taste of living, and the trend is to provide a nature feeling. To meet this end, glass doors are designed to be frameless and are widely used in corridors, halls, and even bathrooms to represent a high-quality, aesthetically pleasing appearance by the material of the glass doors and/or paintings thereon. Nevertheless, the doors, regardless of their material, must be openable. FIG. 1 of the drawings illustrates a conventional pivotal device for a frameless glass door. The pivotal device 1 comprises a fixing plate 11 that includes holes 111 so as to be screwed to a wall. A box 12 is securely mounted to the fixing plate 11 by means of extending screws 125 through holes 112 in the fixing plate 11 into an interior of the box 12. The box 12 includes a horizontal space 121 and a vertical space 122 communicated with the horizontal space 121. Two horizontal pegs 120 are mounted in the horizontal space 121 and each includes a stem 126 and an enlarged head 123. A spring 124 is mounted around the stem 126 of each peg 120. A vertical pivot pin 13 is mounted in the vertical space 122 of the box 12 and in contact with the enlarged heads 123 of the pegs 120.

Two U-shape outer plates 14 and 15 are provided outside the box 12 and thus sandwich the box 12. Screws 144 are extended through holes 151 in plate 15 and into screw holes 145 in a U-shape rib 142 on a side of plate 14. Two limbs 141 of the U-shape rib 142 include aligned grooves 143 for receiving two ends 133 of the pivot pin 13, respectively. Each end 133 of the pivot pin 13 includes two opposite flat surfaces 134 and two opposite arcuate surfaces 135. The mediate portion of the pivot pin 13 also includes two opposite flat surfaces 131 and two opposite arcuate surfaces 132. The box 12 is received in the central cutouts (not labeled) of the U-shape outer plates 14 and 15 to allow relative pivotal movements therebetween. A U-shape two-layer gasket made from elastomeric material is securely sandwiched between the outer plates 14 and 15. As illustrated in FIG. 2, an edge of a glass door 3 is held between two layers 147 and 148 of elastomeric material. A screw 145 is extended through a screw hole 146 in each limb 141 of the U-shape rib 142 to bear against an associated flat surface 134 of the pivot pin 13. Thus, the glass door 3 and the outer plates 14 and 15 can be pivoted relative to the box 12 about a pivotal axis of the pivot pin 13. As illustrated in FIGS. 2 and 3, the enlarged head 123 of each peg 120 is pressed against by either the flat surface 131 or the arcuate surface 132 of the pivot pin 13. However, the enlarged heads 123 of the pegs 120 are twisted during a transition movement between the arcuate surface 132 and the flat surface 131. It was found that movements of the pegs 120 are unstable under the twisting effect and the pivotal movements are not smooth, since the pegs 120 are separate from each other and the contact surface area between the enlarged heads 123 of the pegs 120 and the flat surface 131 (or the arcuate surface 132) is small.

SUMMARY OF THE INVENTION

It is the primary object of the present invention to provide a pivotal device that assures stable, smooth pivotal movements for a frameless glass door.

A pivotal device for a frameless glass door in accordance with the present invention comprises:

a fixing plate adapted to be fixed to a wall;

a box securely attached to the fixing plate and including a horizontal space and a vertical space communicated with the horizontal space;

a follower slidably mounted in the horizontal space of the box and including a first side facing the vertical space and a second side facing away from the vertical space, two stubs projecting from the second side of the follower, a spring being mounted around each said stub and having an end attached to the fixing plate;

a first outer plate and a second outer plate mounted to two sides of the box, the first outer plate and the second outer plate being secured together and sandwiching the box and being pivotable relative to the box, the first outer plate including a U-shape rib having two limbs, each said limb including a groove;

a pivot pin pivotally mounted in the vertical space of the box, the pivot pin including two ends and a mediate portion, the mediate portion including two opposite flat surfaces and two opposite arcuate surfaces, each said end of the pivot pin being received in the groove of an associated said limb of the U-shape rib and including two opposite flat surfaces and two opposite arcuate surfaces;

a gasket securely sandwiched between the first outer plate and the second outer plate to move therewith, the gasket including a portion adapted to securely engage with an edge of a frameless glass door;

wherein the first side of the follower is pressed against by one of the flat surfaces and the arcuate surfaces of the mediate portion of the pivot pin during pivotal movement of the first outer plate, the second outer plate, and the gasket relative to the box.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
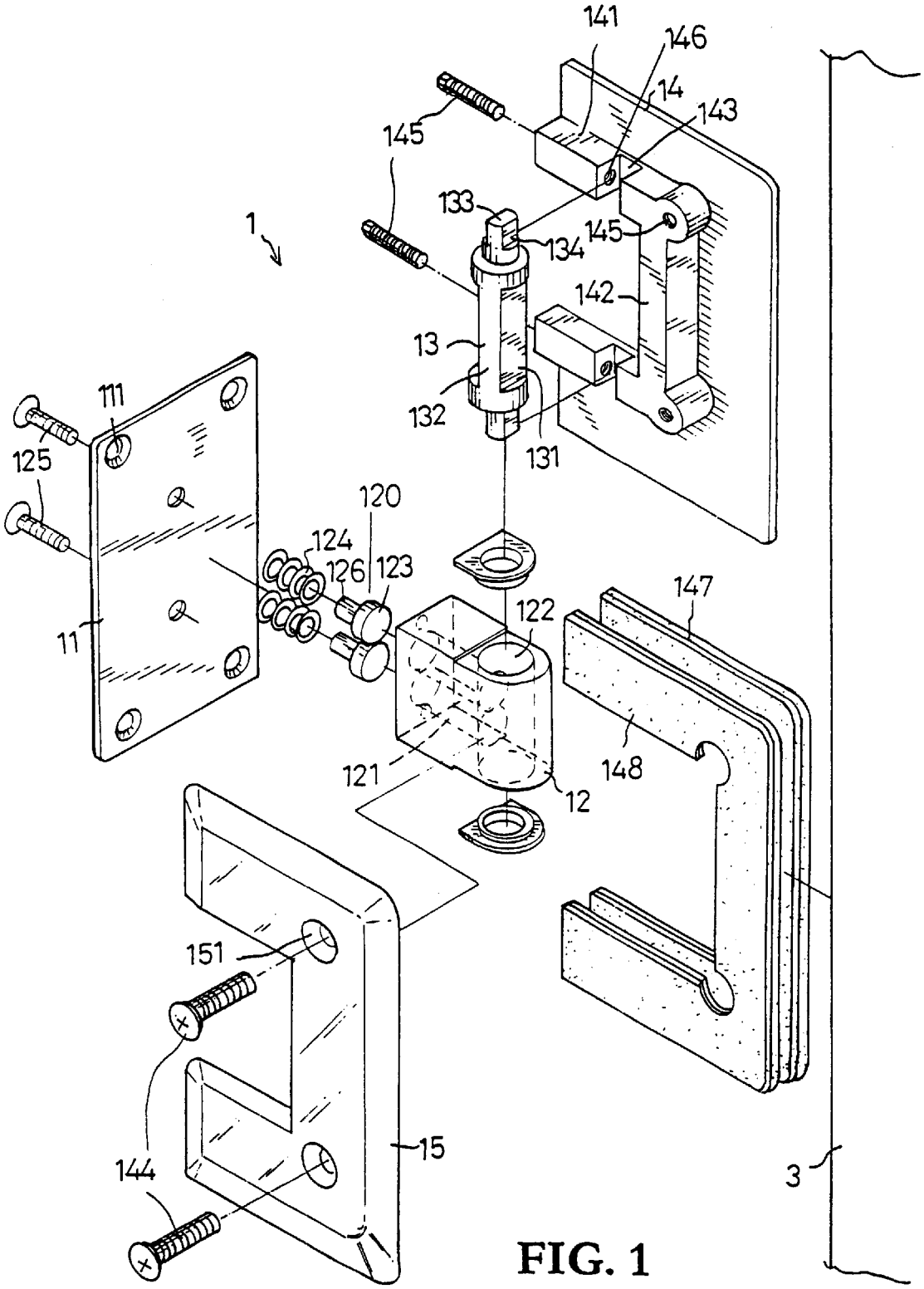
FIG. 1 (PRIOR ART)
FIG. 1 is an exploded perspective view of a conventional pivotal device for a frameless glass door.
Figure 2:
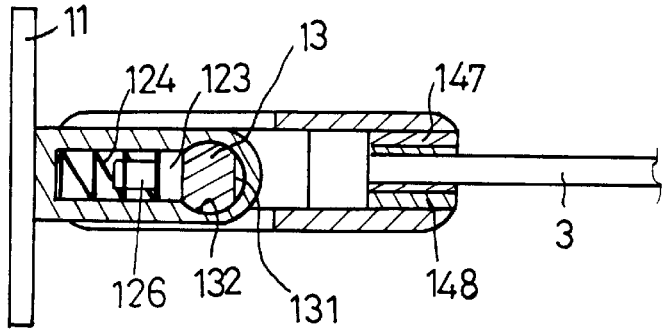
FIG. 2 (PRIOR ART)
FIG. 2 is a sectional top view of the conventional pivotal device.
Figure 3:
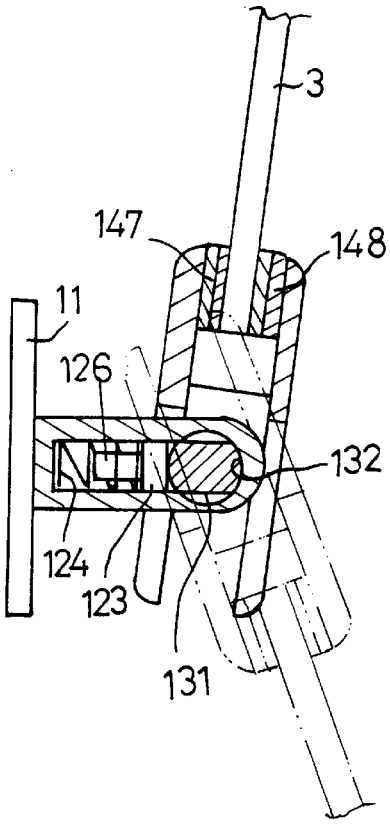
FIG. 3 (PRIOR ART)
FIG. 3 is a view similar to FIG. 2, illustrating operation of the conventional pivotal device.
Figure 4:
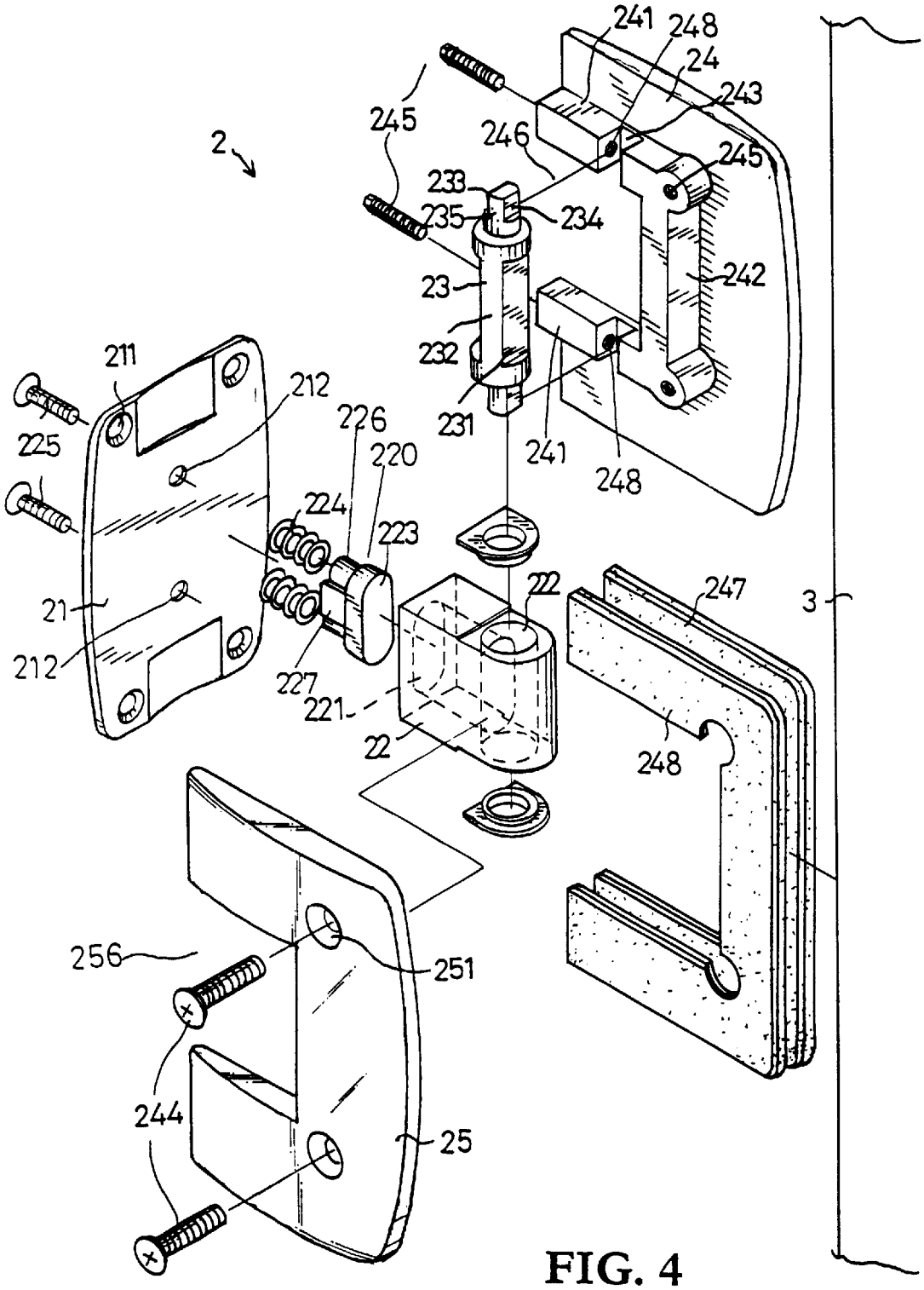
FIG. 4 is an exploded perspective view of a pivotal device for a frameless glass door in accordance with the present invention.
Figure 5:
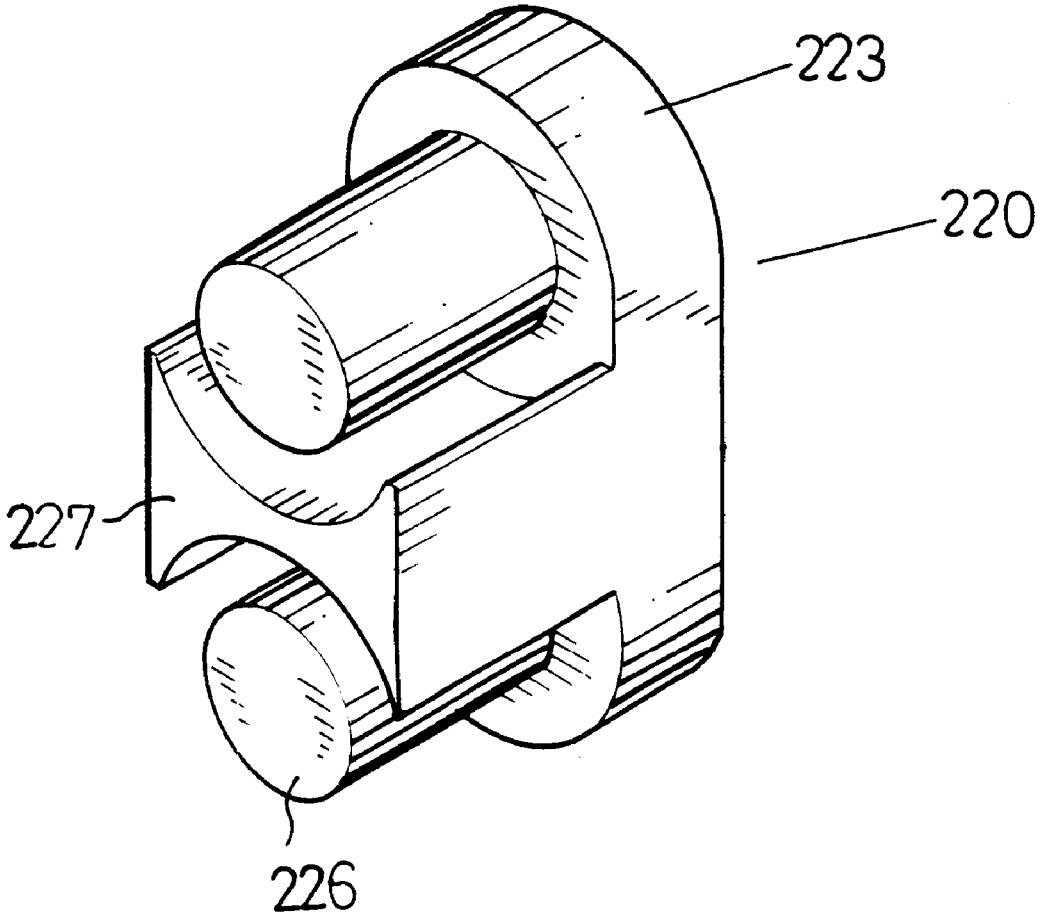
FIG. 5 is a perspective view of a follower of the pivotal device in accordance with the present invention.
Figure 6:
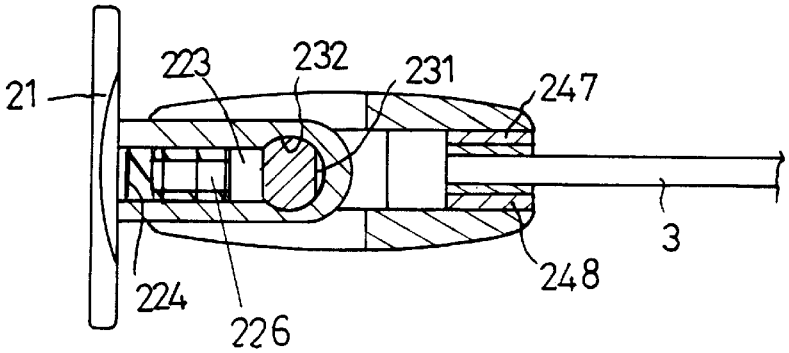
FIG. 6 is a sectional top view of the pivotal device in accordance with the present invention.

Referring to FIGS. 4 through 8 and initially to FIGS. 4 and 6, a pivotal device 2 in accordance with the present invention generally includes a fixing plate 21 that includes holes 211 so as to be screwed to a wall. A box 22 is securely mounted to the fixing plate 21 by means of extending screws 225 through holes 212 in the fixing plate 21 into an interior of the box 22. The box 22 includes a horizontal space 221 and a vertical space 222 communicated with the horizontal space 221. A vertical pivot pin 23 is mounted in the vertical space 222 of the box 22, which will be described later. A follower 220 is slidably mounted in the horizontal space 221 and includes a first side 223 facing the vertical space 222 and a second side (not labeled) facing away from the vertical space 222. As illustrated in FIG. 5, two stubs 226 project from the second side of the follower 220 and a spacer 227 also project from the second side of the follower 220 and located between the stubs 226. A spring 224 is mounted around each stub 226 and has an end attached to the fixing plate 21, as shown in FIG. 6.

wo U-shape outer plates 24 and 25 are provided outside the box 22 and thus sandwich the box 22. Screws 244 are extended through holes 251 in plate 25 and into screw holes 245 in a U-shape rib 242 on an inner side of plate 24. Two limbs 241 of the U-shape rib 242 include aligned grooves 243 for receiving two ends 233 of the pivot pin 23, respectively. Each end 233 of the pivot pin 23 includes two opposite flat surfaces 234 and two opposite arcuate surfaces 235. The mediate portion of the pivot pin 23 also includes two opposite flat surfaces 231 and two opposite arcuate surfaces 232. The box 22 is received in the central cutouts 246 and 256 of the U-shape outer plates 24 and 25 to allow relative pivotal movements therebetween. A U-shape two-layer gasket made from elastomeric material is securely sandwiched between the outer plates 24 and 25. As illustrated in FIG. 6, an edge of a glass door 3 is held between two layers 247 and 248 of elastomeric material. A screw 245 is extended through a screw hole 248 in each limb 241 of the U-shape rib 242 to bear against an associated flat surface 234 of the pivot pin 23. Thus, the glass door 3 and the outer plates 24 and 25 can be pivoted relative to the box 22 about a pivotal axis of the pivot pin 23.

Figure 7:
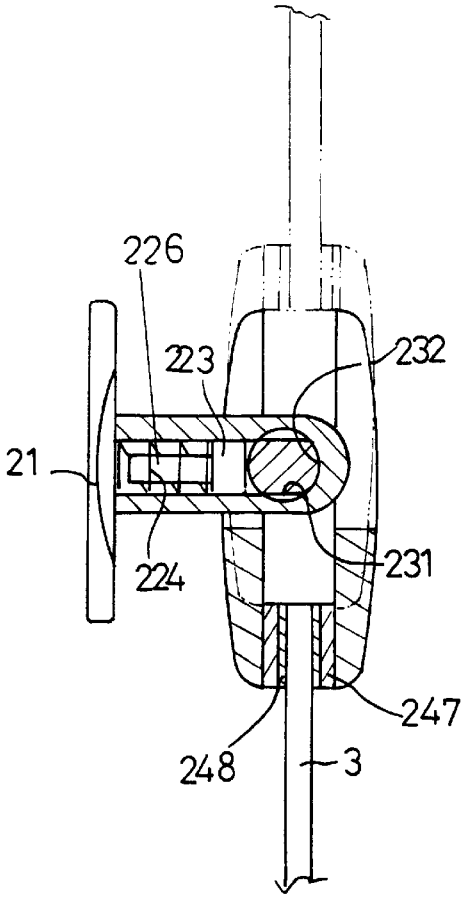
FIG. 7 is a view similar to FIG. 6, illustrating operation of the pivotal device in accordance with the present invention.

As illustrated in FIGS. 6 and 7, the glass door 3 and the box 22 as well as the outer plates 24 and 25 are together pivotable between a closed position (FIG. 6) and an open position (FIG. 7). The first side 223 of the follower 220 is pressed against by either the flat surface 231 (FIG. 6) or the arcuate surface 232 of the pivot pin 23 (FIG. 7). Unstable movement of the follower 220 in the horizontal space 221 is prevented, as the first side 223 of the follower 220 has a wider area. More specifically, the whole area of the first side 223 of the follower 220 is pressed against by the flat surface 231 of the pivot pin 23, best shown in FIG. 6, and the arcuate surface 232 of the pivot pin 23 presses against the first side 223 of the follower 200 by an area larger than that of the conventional design, best shown in FIG. 7. Thus, the drawback resulting from the twisting effect and the non-smooth operation during transition between the arcuate surface 132 and the flat surface 131 are avoided.

Figure 8:
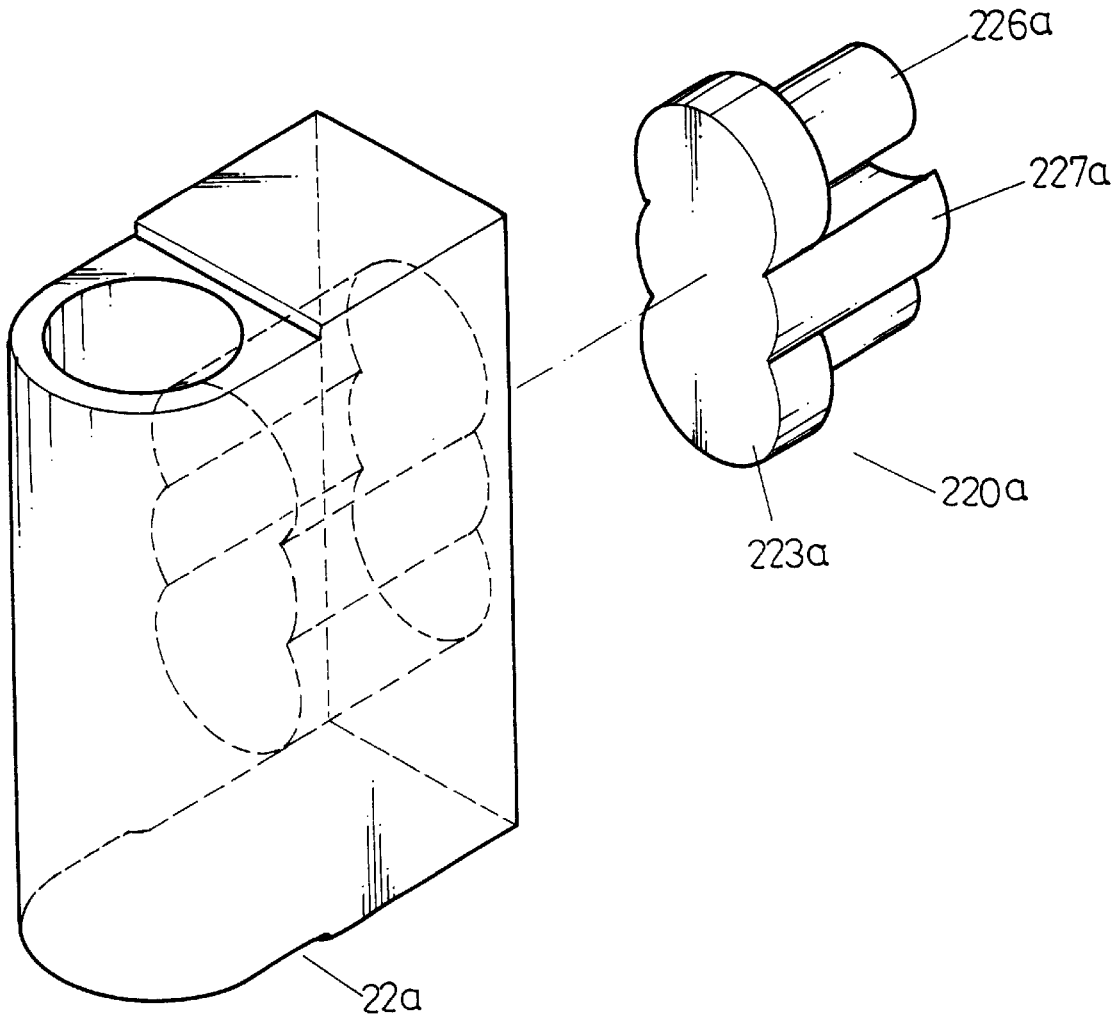
FIG. 8 is an exploded perspective view illustrating a modified embodiment of a box and a follower of the pivotal device in accordance with the present invention.

FIG. 8 illustrates a modified embodiment of the box 22*a* and the follower 220*a*, wherein the follower 220*a* includes a first side 223*a* and a second side from which two stubs 226*a* and a spacer 227*a* between the stubs 226*a* project. The outline of the follower 220*a* and the contour of the horizontal space of the box 22*a* are different from those of the first embodiment.

Although the invention has been explained in relation to its preferred embodiment, it is to be understood that many other possible modifications and variations can be made without departing from the scope of the invention as hereinafter claimed.

What is claimed is:

1. A pivotal device for a frameless glass door, the pivotal device comprising:

a fixing plate adapted to be fixed to a wall;

a box securely attached to the fixing plate and including a horizontal space and a vertical space communicated with the horizontal space;

a follower slidably mounted in the horizontal space of the box and including a first side facing the vertical space and a second side facing away from the vertical space, two stubs projecting from the second side of the follower, a spring being mounted around each said stub and having an end attached to the fixing plate;

a first outer plate and a second outer plate mounted to two sides of the box, the first outer plate and the second outer plate being secured together and sandwiching the box and being pivotable relative to the box, the first outer plate including a U-shape rib having two limbs, each said limb including a groove;

a pivot pin pivotally mounted in the vertical space of the box, the pivot pin including two ends and a mediate portion, the mediate portion including two opposite flat surfaces and two opposite arcuate surfaces, each said end of the pivot pin being received in the groove of an associated said limb of the U-shape rib and including two opposite flat surfaces and two opposite arcuate surfaces;

a gasket securely sandwiched between the first outer plate and the second outer plate to move therewith, the gasket including a portion adapted to securely engage with an edge of a frameless glass door;

wherein the first side of the follower is pressed against by one of the flat surfaces and the arcuate surfaces of the mediate portion of the pivot pin during pivotal movement of the first outer plate, the second outer plate, and the gasket relative to the box.

2. The pivotal device as claimed in claim 1, further comprising a spacer projecting from the second side of the follower and located between the stubs.

* * * * *